US007954185B2

(12) United States Patent
Narboni-Campora

(10) Patent No.: US 7,954,185 B2
(45) Date of Patent: Jun. 7, 2011

(54) EXPANDABLE SLEEPING BAG

(76) Inventor: Chantal Celine Narboni-Campora, New York, NY (US)

( * ) Notice: Subject to any disclaimer, the term of this patent is extended or adjusted under 35 U.S.C. 154(b) by 0 days.

(21) Appl. No.: 12/692,840

(22) Filed: Jan. 25, 2010

(65) Prior Publication Data

US 2010/0175188 A1 Jul. 15, 2010

Related U.S. Application Data

(63) Continuation of application No. 11/963,565, filed on Dec. 21, 2007, now Pat. No. 7,650,655.

(60) Provisional application No. 60/871,199, filed on Dec. 21, 2006.

(51) Int. Cl.
*A47G 9/08* (2006.01)

(52) U.S. Cl. ..... 5/413 R; 2/69.5

(58) Field of Classification Search ..... 5/413 R, 5/493, 484, 413 AM; 2/69.5
See application file for complete search history.

(56) References Cited

U.S. PATENT DOCUMENTS 3,584,323 A 6/1971 Worley
5,560,043 A * 10/1996 Armstrong ..... 2/69.5
6,073,282 A 6/2000 Leeper et al.

* cited by examiner

*Primary Examiner* — Fredrick Conley
(74) *Attorney, Agent, or Firm* — Volpe and Koenig, PC

(57) ABSTRACT

An expandable sleeping bag or bunting bag includes features in which the size of the bag is adjustable to accommodate the growth of the child. To expand or contract the sleeping bag in width, one or more additional tapes of zipper teeth are sewn to the front of the garment adjacent to, and parallel to, the regular zipper. To expand or contract the sleeping bag in length, a pair of parallel zippers permits the removal or insertion of a length expansion strip extending around the circumference of the sleeping bag.

18 Claims, 4 Drawing Sheets

EXPANDABLE SLEEPING BAG

CROSS REFERENCE TO RELATED APPLICATIONS

This application is a continuation of U.S. patent application Ser. No. 11/963,565, filed Dec. 21, 2007 now U.S. Pat. No. 7,650,655, which claims the benefit of U.S. Provisional Patent application No. 60/871,199 filed Dec. 21, 2006, which are incorporated by reference as if fully set forth.

FIELD OF INVENTION

The present invention relates to improvements in the field of adjustable size sleeping bags.

BACKGROUND

A sleeping bag is a large padded bag design to be slept in. A bunting bag, similar to a sleeping bag, is a thick, warm garment for a baby that is shaped like a sleeping bag to cover the baby's body and legs, and usually includes a hood. Sleeping bags (or bunting bags) for use by children may have slits or openings in the back through which harnesses (such as from strollers and car seats) or seatbelts may pass through in order to allow safe use of the sleeping bag in child strollers, car seats and automobiles. Such sleeping bags for children are typically used as outer garments in cold weather.

A bunting bag or sleeping bag is generally chosen to fit the size of the child. Typically, a child starts with a small sleeping bag. Eventually, the child outgrows the small sleeping bag, in which case a larger sleeping bag must be purchased. Thus, is not uncommon for a child to require use of several successively larger sleeping bags as the child grows.

Adjustable size bunting bags are known. A baby robe with an adjustable length is shown in U.S. Pat. No. 4,773,101 to Kapp et al. A one-piece infant bunting with Velcro fasteners to accommodate the size of the infant is shown in U.S. Pat. No. 4,897,885 to Lunt.

Adjustable size sleeping bags are known. Maguire (in U.S. Pat. Nos. 4,079,472 and 4,197,601) shows a sleeping bag with a longitudinally extensible and laterally expandable foot section. Maguire shows a sleeping bag constructed of a single rectangularly-shaped sheet of bed-sheet fabric having an accordion fold at the feet thereof, to permit the foot portion of the sleeping bag to be longitudinally extensible to permit the length of the bag to be comfortably utilized by a slightly taller person.

U.S. Pat. No. 6,175,976 to Cantwell also shows a sleeping bag with an adjustable foot space. The sleeping bag by Cantwell is selectively convertible between a compact foot space configuration (mummy bag) and an expanded foot space configuration (rectangular type sleeping bag).

U.S. Pat. No. 6,216,290 Zemitis et al. show a sleeping bag that is expandable in width by having an access zipper and expansion zipper. The expansion zipper has a draft tube expansion segment, which is used to expand the circumference of the sleeping bag's interior lining and outer shell.

U.S. Pat. No. 6,438,774 to Michaelis et al. shows a convertible sleeping bag using a pair of zippers to allow users to adjust the bag between a conventional rectangular bag and a narrowed mummy style bag.

SUMMARY

The present invention is embodied in a sleeping bag (or bunting bag) in which the size of the bag is adjustable to accommodate the growth of the child. The sleeping bag in accordance with the present invention may be expanded (or contracted) in width and/or expanded (or contracted) in length.

In order to expand (or contract) the width of the sleeping bag, an additional tape of zipper teeth is attached to the front of the garment adjacent to, and parallel to, the (regular) first zipper. When one of the tapes of zipper teeth from the first (regular) zipper is meshed with the additional tape of zipper teeth, the width of the bag is reduced, i.e., the circumference of the bag is reduced. Further additional tapes of zipper teeth may be provided adjacent to, and parallel to, the first additional tape of zipper teeth. When the one of the tapes of zipper teeth from the first zipper is meshed with one of the further additional tapes of zipper teeth, the width of the bag is further reduced.

In order to expand (or contract) the length of the sleeping bag, a pair of parallel zippers around the circumference of the sleeping bag is provided, which define a strip of material forming a length expansion strip extending around the circumference of the sleeping bag. The pair of parallel zippers permits the removal or insertion of such length expansion strip. To shorten the length of the sleeping bag, the length expansion strip extending around the circumference of the sleeping bag is removed. The remaining bottom portion of the sleeping bag is joined to the remaining top portion of the sleeping bag by meshing the tape of zipper teeth on the bottom portion of the sleeping bag to the tape of zipper teeth on the top portion of the sleeping bag. To further increase the length of the sleeping bag, and additional length expansion strips may be added, such additional length expansion strip having tapes of zipper teeth attached to the edges thereof that mesh with the tapes of zipper teeth on the edge of each respective adjacent length expansion strip.

In such matter, the length and width of a sleeping bag in accordance with the present invention may be adjusted to fit the child. As the child grows, the sleeping bag of the present invention may be expanded in width and/or length to accommodate the growth and fit properly. Therefore, the sleeping bag of the present invention is economical because it is not necessary to purchase additional sleeping bags as the child grows. Furthermore, because the sleeping bag of the present invention is adjustable to fit the child better (i.e. fit more closely) the sleeping bag will be warmer.

BRIEF DESCRIPTION OF THE DRAWING(S)

DETAILED DESCRIPTION OF THE PREFERRED EMBODIMENT

Figure 1:
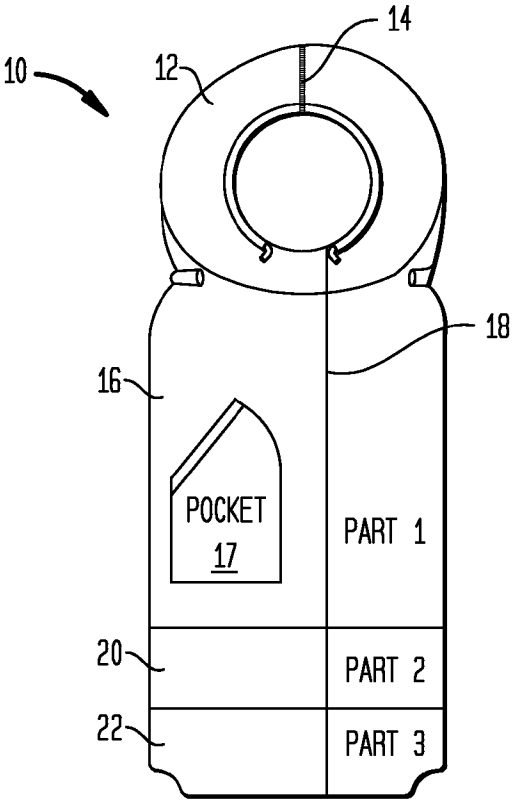
FIG. 1 is a front view of an expandable sleeping bag in accordance with the present invention.

An expandable sleeping bag 10 shown in FIG. 1 includes a hood 12, a hood zipper 14, a blanket body 16, a length expansion strip 20 and a bottom piece 22. A pocket 17 is provided on the blanket body 16 for utility storage. A regular zipper 18 is used to close the sleeping bag around the wearer.

Figure 2:
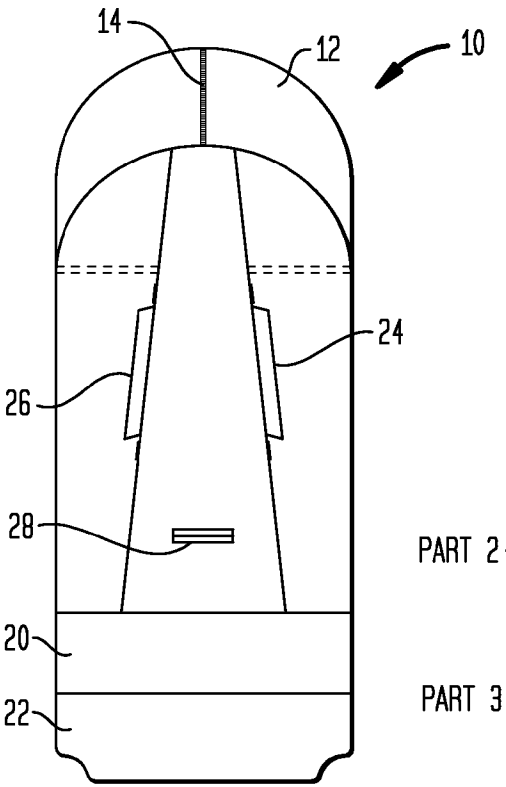
FIG. 2 is a back view of an expandable sleeping bag in accordance with the present invention.

As shown in the back view of FIG. 2, the expandable sleeping bag 10 further includes slits or openings 24, 26 and 28 to accommodate a seatbelt or harness straps as may be found in an automobile, car seat or stroller. The expandable sleeping bag of the present invention may be tucked into a car seat or stroller, while the straps of the restraining device (seatbelt or harness) are passed through the slits 24, 26, 28 to hold a child safety in place. The front of the expandable sleeping bag is then enclosed around the child.

Figure 3:
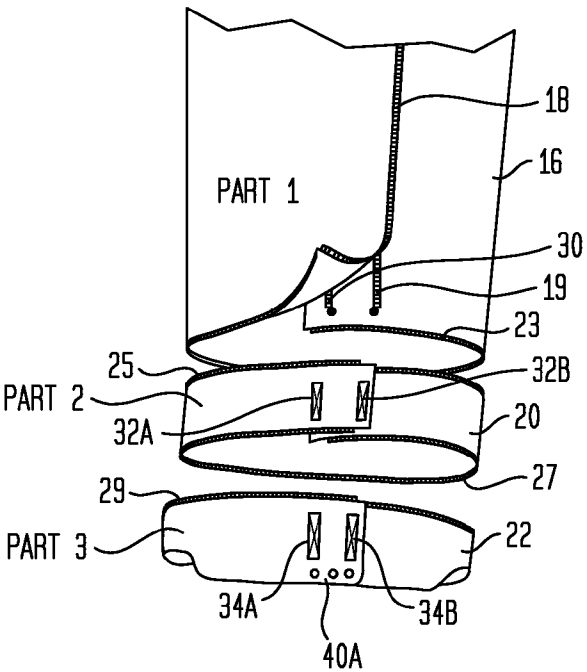
FIG. 3 is an exploded isometric view of the bottom portion of an expandable sleeping bag in accordance with the present invention.

FIG. 3 shows the arrangement facilitating the expansion of the sleeping bag 10 in both width and length. A first tape of zipper teeth 18 and a second tape of zipper teeth 30 form a first zipper (the regular zipper). A third tape of zipper teeth 19 is attached to the blanket body 16 of the sleeping bag 10.

Figure 7:
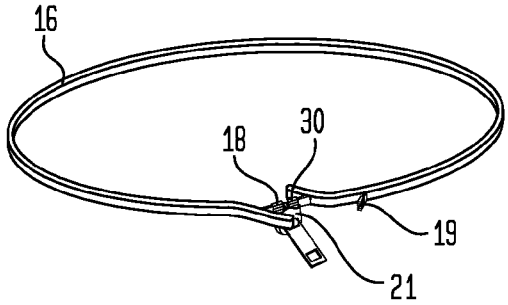
FIG. 7 is a cross-sectional view of an expandable sleeping bag expanded to a larger width configuration in accordance with the present invention.
Figure 8:
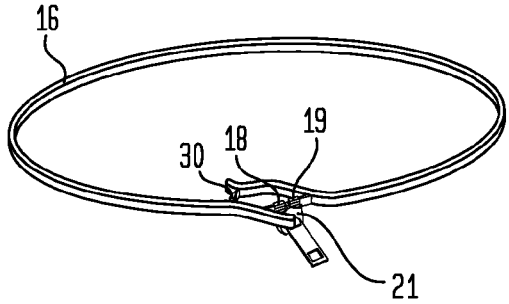
FIG. 8 is a cross-sectional view of an expandable sleeping bag contracted to a smaller width configuration in accordance with the present invention.

When the first tape of zipper teeth 18 is meshed to the second tape of zipper teeth 30 the width of the garment blanket body 16 is maximized. When the first tape of zipper teeth 18 is meshed to the third tape of zipper teeth 19 the width of the blanket body 16, is reduced. The arrangement is illustrated in cross-sectional form in FIGS. 7 and 8. In FIG. 7, slider 21 meshes the first tape of zipper teeth 18 to the second tape of zipper teeth 30, in which case the width of the garment blanket body 16 is maximized. In FIG. 8, slider 21 meshes the first tape of zipper teeth 18 to the third tape of zipper teeth 19, in which case the width of the garment blanket body 16 is reduced.

The arrangement facilitating the expansion of the sleeping bag 10 in length is also illustrated in FIG. 3. In particular, a pair of parallel zippers (23, 25 and 27, 29) around the circumference of the sleeping bag 10 defines a length expansion strip 20. For a longer sleeping bag, the length expansion strip 20 is attached to zippers above and below to become part of the sleeping bag. The length expansion strip 20 is secured at the front by using Velcro (hook and loop) fasteners 32A and 32B, one of which will attach to a corresponding hook and loop fastener (37 in FIG. 9). To complete the sleeping bag configuration, the tape of zipper teeth 29 on the bottom piece 22 is meshed to the tape of zipper teeth 27 on the length expansion strip 20. The bottom piece 22 is a strip of material extending around us a conference of the sleeping bag. In order to close the bottom piece 22 in the front, hook and loop fasteners 34A and 34B, one of which will attach to a corresponding hook and loop fastener (35 in FIG. 9) and bottom snaps 40A are provided.

Figure 4:
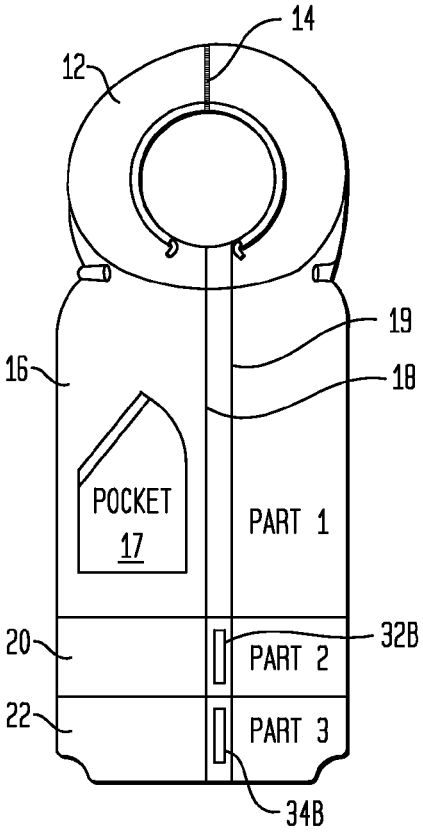
FIG. 4 is a front view of an expandable sleeping bag expanded to a larger configuration in accordance with the present invention.
Figure 5:
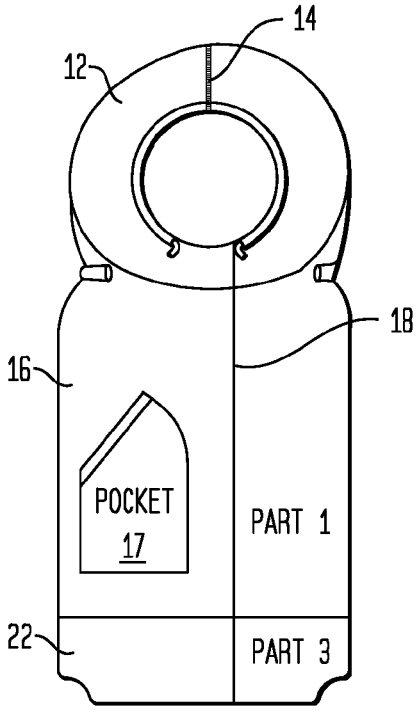
FIG. 5 is a front view of an expandable sleeping bag contracted to a smaller configuration in accordance with the present invention.
Figure 6:
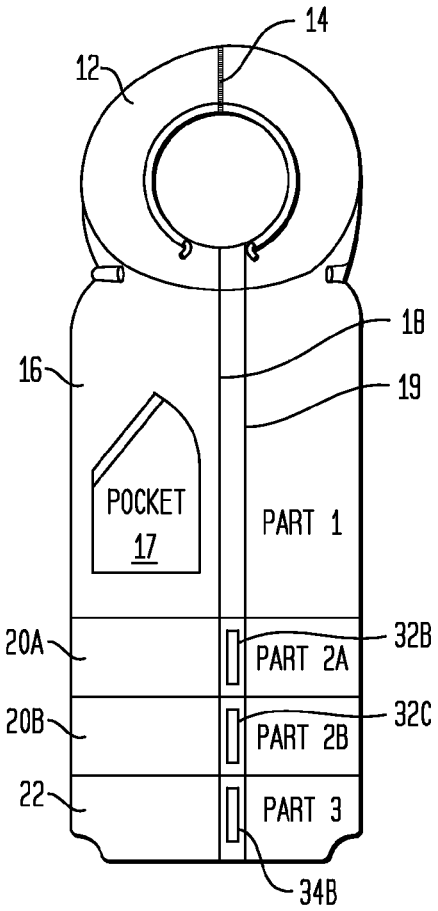
FIG. 6 is a front view of an expandable sleeping bag expanded to a longer configuration in accordance with the present invention.

Different configurations of the expandable sleeping bag are shown in FIG. 4, FIG. 5 and FIG. 6. In FIG. 4 the expandable sleeping bag is made wider as compared to the configuration shown in FIG. 1. In the latter configuration, the additional tape of zipper teeth 19 is visible. Also, the Velcro hook and loop fasteners 32B, 34B on the additional length expansion strip 20 and the bottom piece 22, respectively, are visible.

In FIG. 5 the expandable sleeping bag is made shorter as compared to the configuration in FIG. 1. In the latter configuration the length expansion strip extending around the circumference of the sleeping bag (20 in FIG. 1) has been removed.

In FIG. 6 the expandable sleeping bag is made both wider and longer as compared to the configuration shown in FIG. 1. In the latter configuration yet another length expansion strip 20B extending around the circumference of the sleeping bag has been added.

Consistent with the present invention, further additional tapes of zipper teeth may be attached to the front of the garment adjacent to, and parallel to, the other tapes of zipper teeth 18, 19. Similarly, the expandable sleeping bag may be made yet longer by adding additional length expansion strips extending around the circumference of the sleeping bag.

Figure 9:
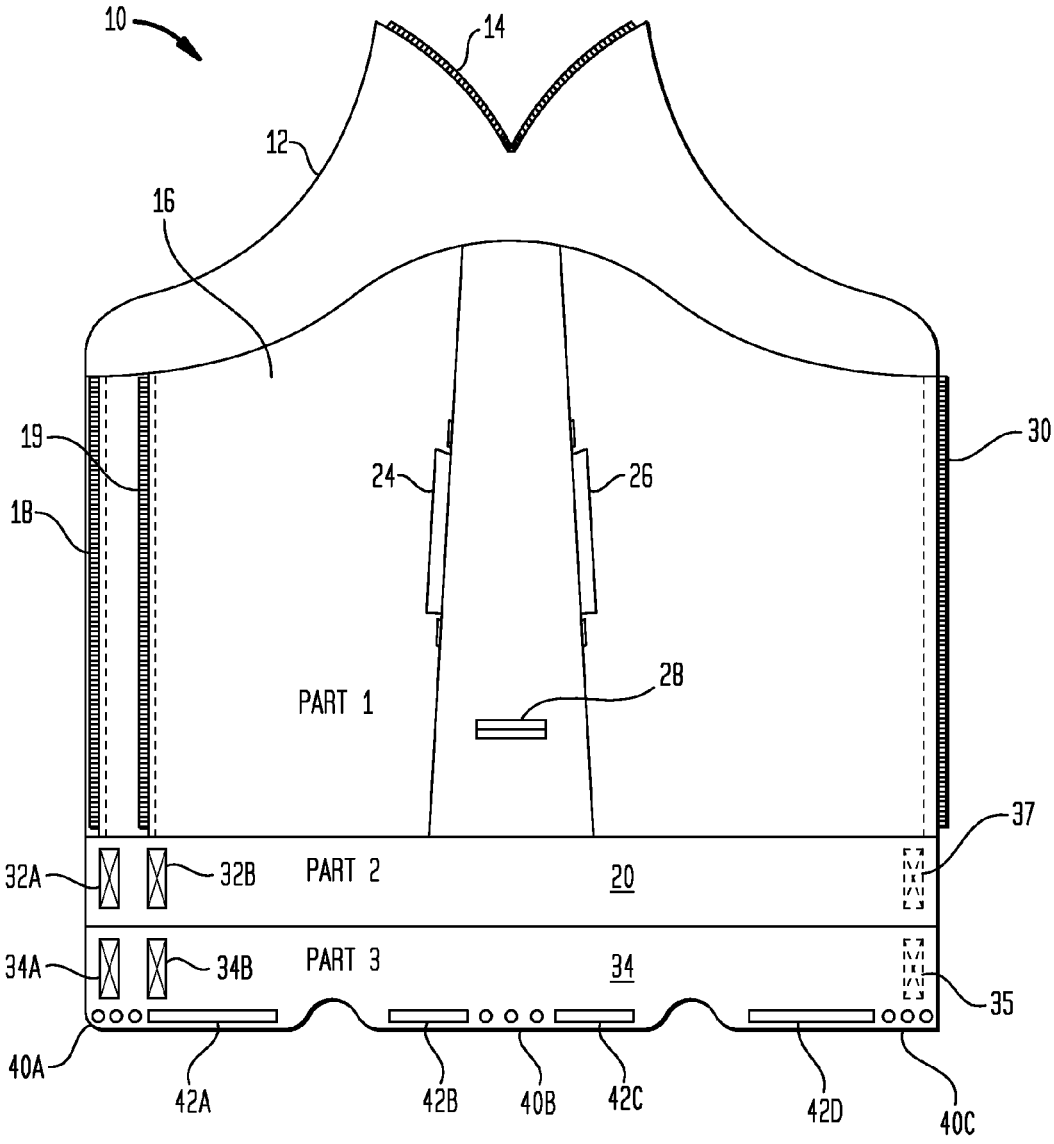
FIG. 9 is an exterior view of an open (i.e. an unzipped) expandable sleeping bag in accordance with the present invention.

FIG. 9 shows an outside view of the expandable sleeping bag 10 with all of its zippers open. Hood zipper 14 is opened so that the hood portion 12 lies flat. On the left side, a first tape of zipper teeth 18 is sewn to the edge of the garment. On the right side a second tape of zipper teeth 30 is sewn to the other edge of the garment. An additional tape of zipper teeth 19 is attached to the front of the garment adjacent to, and parallel to, the first tape of zipper teeth 18.

The additional length expansion strip 20 extending around the circumference of the sleeping bag includes fasteners 32A and 32B, which correspond in position to zippers 18 and 19 respectively. The length expansion strip 20 further includes a fastener 37, which corresponds in position to zipper 30. Similarly, the bottom piece 34 includes fasteners 34A and 34B, which correspond in position to zippers 18 and 19 respectively. The bottom piece 34 further includes a fastener 35, which corresponds in position to zipper 30.

The bottom piece 34 further includes fasteners 40A, 42A, 42B, 40B, 42C, 42D and 40C at the bottom edge thereof so that the bottom edge can be sealed when the zippers of the expandable sleeping bag are meshed so as to form a sleeping bag. In particular, a series of hook and loop fasteners 42A, 42B, 42C and 42D are available to seal the bottom of the expandable sleeping bag. In addition, a series of snaps 40A, 40B and 40C are available to seal the bottom of the expandable sleeping bag. The length expansion strip 20 and the bottom piece 34 are similar in function in that each is a strip that functions to expand the length of the sleeping bag. The primary difference between the two is that the bottom edge of the bottom piece 34 is configured with fasteners to seal to itself while the bottom edge of the length expansion strip 20 is configured with fasteners to receive yet another length expansion strip or a bottom piece.

The fasteners 32A and 32B permit the length expansion strip 20 to be expandable in width in the same manner that fasteners 18 and 19 permit the sleeping bag to be expanded or contracted in width. In particular, fastener 37 meshes with fastener 32A to expand the width of the sleeping bag. Alternatively fastener 37 meshes with fastener 32B to contract the width of the sleeping bag. The fasteners 34A and 34B permit the bottom piece 22 to be expandable in width in the same manner that fasteners 18 and 19 permit the sleeping bag (along with one or more length expansion strips 20) to be expanded or contracted in width. In particular, fastener 35 meshes with fastener 34A to expand the width of the sleeping bag. Alternatively fastener 35 meshes with fastener 34B to contract the width of the sleeping bag.

As a result, the sleeping bag of the present invention may be independently expanded in width and length. It should be understood that while some of the fasteners described herein are specifically indicated as either zippers, Velcro (hook and loop) and/or snaps, these fasteners may be interchanged with each other or other types of fasteners (e.g. buttons) may be substituted without departing from the spirit of the invention.

What is claimed is:

1. A sleeping bag comprising:

a blanket body having inner and outer surfaces, respective first and second side edges and a bottom edge;

a first row of fasteners attached to the first side edge of the blanket body;

a second row of fasteners attached to the outer surface at a first distance from the second side edge of the blanket body, the second row of fasteners being adapted to mesh with the first row of fasteners;

a third row of fasteners substantially parallel to the first and second rows of fasteners and attached to the outer surface at a second distance, greater than the first distance, from the second side edge of the blanket body, the third rows of fasteners being adapted to mesh with the first row of fasteners;

a fourth row of fasteners attached to the bottom edge of the blanket body; and at least one length expansion strip removably attached to the blanket body and having respective first and second edges, the first edge being substantially equal to the bottom edge of the blanket body, the first edge of the length expansion strip having a fifth row of fasteners, the fifth row of fasteners mesh with the fourth row of fasteners to attach the length expansion strip to the blanket body.

2. A sleeping bag in accordance with claim 1, further comprising:

a sixth row of fasteners attached to the second edge of the length expansion strip; and a bottom piece removably attached to the at least one length expansion strip having respective first and second edges, the first edge being substantially equal to the second edge of the length expansion strip, the bottom piece having a seventh row of fasteners attached to the first edge thereof, the seventh row of fasteners mesh with the sixth row of fasteners to attach the bottom piece to the at least one length expansion strip, the second edge of the bottom piece having a plurality of fasteners attached thereto so as to seal one portion of the second edge of the bottom piece to another portion of the second edge of the bottom piece.

3. A sleeping bag in accordance with claim 2, wherein the sixth and seventh rows of fasteners comprise respective tapes of zipper teeth.

4. A sleeping bag in accordance with claim 2, wherein the plurality of fasteners along the second edge of the bottom piece comprise hook and loop fasteners.

5. A sleeping bag in accordance with claim 1, wherein the first, second, third, fourth, and fifth rows of fasteners comprise respective tapes of zipper teeth.

6. A sleeping bag in accordance with claim 1, wherein the blanket body further comprises a top portion, opposite the bottom edge and having a hood.

7. A sleeping bag comprising:

a blanket body having inner and outer surfaces, respective first and second side edges and a bottom edge;

a first row of fasteners attached to the first side edge of the blanket body;

a second row of fasteners attached to the outer surface at a first distance from the second side edge of the blanket body, the second row of fasteners being adapted to mesh with the first row of fasteners;

a third row of fasteners substantially parallel to the first and second rows of fasteners and attached to the outer surface at a second distance, greater than the first distance, from the second side edge of the blanket body, the third row of fasteners being adapted to mesh with the first row of fasteners;

a fourth row of fasteners attached to the bottom edge of the blanket body; and a bottom piece removably attached to the blanket body and having respective first and second edges, the bottom piece having a fifth row of fasteners attached to the first edge thereof, the fifth row of fasteners mesh with the fourth row of fasteners to attach the bottom piece to the blanket body, the second edge of the bottom piece having a plurality of fasteners attached thereto so as to seal one portion of the second edge of the bottom piece to another portion of the second edge of the bottom piece.

8. A sleeping bag in accordance with claim 7, further comprising:

a length expansion strip being interposed between the blanket body and the bottom piece to increase the length of the sleeping bag;

the length expansion strip having respective first and second edges, the first edge thereof being substantially equal to the bottom edge of the blanket body, the second edge thereof being substantially equal to the first edge of the bottom piece, the first edge of the length expansion strip having a sixth row of fasteners, the second edge of the length expansion strip having a seventh row of fasteners; and the sixth row of fasteners mesh with the fourth row of fasteners on the blanket body to removably attach the length expansion strip to the blanket body, and the seventh row of fasteners mesh with the fifth row of fasteners on the bottom piece to removably attach the length expansion strip to the bottom piece.

9. A sleeping bag in accordance with claim 8, wherein the sixth and seventh rows of fasteners comprise respective tapes of zipper teeth.

10. A sleeping bag in accordance with claim 7, wherein the plurality of fasteners along the second edge of the of the bottom piece comprise hook and loop fasteners.

11. A sleeping bag in accordance with claim 7, wherein the first, second, third, fourth, and fifth rows of fasteners comprise respective tapes of zipper teeth.

12. A sleeping bag comprising:

a blanket body having inner and outer surfaces, respective first and second side edges and a bottom edge;

a first row of fasteners attached to the first side edge of the blanket body;

a second row of fasteners attached to the outer surface at a first distance from the second side edge of the blanket body; and a third row of fasteners substantially parallel to the first and second rows of fasteners and attached to the outer surface at a second distance, greater than the first distance, from the second side edge of the blanket body;

the sleeping bag being convertible between an expanded width configuration in which the first row of fasteners meshes with the second row of fasteners, and a contracted width configuration in which the first row of fasteners meshes with the third row of fasteners.

13. A sleeping bag in accordance with claim 12, wherein the blanket body further comprises a top portion, opposite the bottom edge and having a hood.

14. A sleeping bag in accordance with claim 12, further comprising:

a fourth row of fasteners attached to the bottom edge of the blanket body;

at least one length expansion strip removably attached to the blanket body and having respective top and bottom edges, the top edge thereof being substantially equal to the bottom edge of the blanket body, the top edge of the length expansion strip having a fifth row of fasteners that mesh with the fourth row of fasteners to removably attach the length expansion strip to the blanket body, the length expansion strip having a sixth row of fasteners attached to the bottom edge of the length expansion strip;

the length expansion strip further having respective first and second side edges, a seventh row of fasteners attached adjacent to the first side edge of the length expansion strip, an eighth row of fasteners attached to the length expansion strip at a first distance from the second side edge of the length expansion strip; and the length expansion strip further including a ninth row of fasteners substantially parallel to the seventh and eight rows of fasteners and attached to the length expansion strip at a second distance from the second side edge of the length expansion strip, greater than the first distance;

the length expansion strip convertible between an expanded configuration in which the seventh row of fasteners meshes with the eight row of fasteners, and a contracted configuration in which the seventh row of fasteners meshes with the ninth row of fasteners.

15. A sleeping bag in accordance with claim 14, wherein the first, second, third, fourth, fifth, sixth, seventh, eighth and ninth rows of fasteners comprise respective tapes of zipper teeth.

16. A sleeping bag in accordance with claim 14, further comprising:

a bottom piece having respective top and bottom edges, the top edge being substantially equal to the bottom edge of the length expansion strip, the bottom piece having a tenth row of fasteners attached to the top edge thereof that mesh with the sixth row of fasteners on the length expansion strip, the bottom edge of the bottom piece having a plurality of fasteners attached thereto so as to seal one portion of the bottom edge of the bottom piece to another portion of the bottom edge of the bottom piece.

17. A sleeping bag in accordance with claim 16, wherein the plurality of fasteners along the bottom edge of the of the bottom piece comprise hook and loop fasteners.

18. A sleeping bag in accordance with claim 16, wherein the tenth row of fasteners comprises respective tapes of zipper teeth.

* * * * *